United States Patent [19]

Müller-Deinhardt

[11] Patent Number: 4,480,831

[45] Date of Patent: Nov. 6, 1984

[54] EXERCISE HOOP HAVING A COUNTER

[76] Inventor: Friedhelm Müller-Deinhardt, Breslauer Strasse 19, 3006 Burgwedel 1, Fed. Rep. of Germany

[21] Appl. No.: 357,584

[22] Filed: Mar. 12, 1982

[51] Int. Cl.[3] ..... A63B 19/00; A63B 23/02

[52] U.S. Cl. ..... 272/128; 272/DIG. 5; 446/236

[58] Field of Search ..... 46/47, 51; 272/DIG. 5, 272/128; 273/118 A, 11 C

[56] References Cited

U.S. PATENT DOCUMENTS

| | | | |
|---|---|---|---|
| 2,220,593 | 2/1938 | Watson | 272/DIG. 5 |
| 2,600,832 | 6/1952 | Benak | 273/118 A |
| 2,966,561 | 12/1960 | Durant | 273/118 A |
| 3,659,843 | 5/1972 | Kojigian | 272/DIG. 5 |
| 3,784,193 | 1/1974 | Simjian | 272/DIG. 5 |
| 4,006,556 | 2/1977 | Williams | 46/47 |
| 4,071,892 | 1/1978 | Genzling | 272/DIG. 5 |
| 4,262,898 | 4/1981 | Lee | 272/DIG. 5 |

FOREIGN PATENT DOCUMENTS

| | | | |
|---|---|---|---|
| 1678242 | 11/1981 | Fed. Rep. of Germany | 272/DIG. 5 |

*Primary Examiner*—Richard C. Pinkham
*Assistant Examiner*—MaryAnn Stoll
*Attorney, Agent, or Firm*—Allegretti, Newitt, Witcoff & McAndrews, Ltd.

[57] ABSTRACT

The device comprises a hoop with a hollow passage having a weight located within the hollow passage, such that the weight circulates in the hollow passage as the hoop is rhythmically rotated. The device also includes a counter capable of counting and displaying the weight's revolutions around the hoop and a sensor for determining and displaying the speed of the weight.

14 Claims, 6 Drawing Figures

EXERCISE HOOP HAVING A COUNTER

BACKGROUND OF THE INVENTION

The present invention relates to an improvement of the exercise device disclosed in the German Pat. No. 1,678,242. This prior art exercise device basically comprises a hoop with a hollow passage through its circumference. A weight, which is slightly smaller in diameter than the inside diameter of the hoop's hollow passage is placed inside the hollow passage of the hoop. Therefore, the weight will circulate within the hoop's hollow passage when the hoop is rhythmically rotated.

To use this prior art device a person places his body inside the hoop and grabs the hoop on either side. As the person rotates the hoop the weight circulates within the hollow passage creating a substantial centrifugal force. Thus, one must overcome this centrifugal force in order to keep the hoop smoothly rotating about one's body. As the speed of the hoop increases, the rotating speed of the weight and the force necessary to maintain the hoop's rhythmical motion also increase.

Use of this known exercise device stimulates the cardiovascular system, increases physical strength, and improves general muscle tone and coordination. One problem, however, with the device disclosed in the above-mentioned German Patent is that it is decidedly uninteresting to use. Though the effects of the device are excellent if the device is used properly and for a sufficient period of time, it is difficult for most to maintain the concentration and interest level necessary to do so. Often the user becomes bored and stops exercising before his system has realized the salutary results of a proper workout.

A further problem with the existing exercise device is that there is no way for the user to monitor either the number of rotations completed during an exercise period or the speed of the weight's rotation. Thus, the user cannot quantitatively gauge the intensity level of his exercise program. Without such feedback, a user cannot set goals for himself. Since he is unable to tell how long he has exercised or how hard he is exercising, he rarely pushes himself to his limit. Therefore, a user of the prior art exercise device will most likely not realize the full extent of the device's potential benefits.

SUMMARY OF THE INVENTION

It is an object of the present invention to provide an improved exercise device which is interesting to use and, therefore, encourages the user to set higher excercise goals for himself.

It is a further object of the present invention to provide an improved exercise device that monitors the extent and intensity of an exercise program.

It is a specific object of the present invention to provide an improved exercise device that comprises a hoop with a hollow passage having a body capable of circulating within the hollow space when the hoop is rhythmically rotated combined with a counter that displays the number of rotations of the weight.

It is further a specific object of the present invention to provide an improved exercise device of the hoop type capable of measuring both the number of rotations of the weight and the circulating speed of the weight within the hoop.

In accordance with the present invention these objects are achieved by providing an improved exercise device having a hollow hoop with opposed handles and a weight within the hollow space of the hoop. When the hoop is rotated rhythmically, the weight circulates through the hollow passage. In the present invention, a counter is attached to the inside of the hoop such that the counter displays the number of rotations of the weight in a plane substantially parallel to the plane of the hoop. Thus, the user can see at a glance how many revolutions the weight has made around the hoop.

The present improved exercise device may also be provided with a sensor that determines the speed of the circulating weight. Thus, the user can tell how hard he is exercising by the rotating speed of the weight. Furthermore, the improved exercise device may have both a revolution counter and a speed sensor that simultaneously display their respective values.

The counter of the present invention may be a mechanical counter, an electromagnetic counter, an electronic counter, or a photosensitive element. The speed sensor of the present invention may comprise a pair of electrodes separated by a predetermined distance or a single electrode coupled with a time signal transmitter.

Thus, the device of the present invention is much more interesting to use than the prior art exercise devices of the same general design. This means that a user is much more likely to exercise longer and harder than he would with the prior art devices and, thus, more readily achieve the desirable result of physical health.

Other objects and embodiments of the present invention will be found by reference to the following detailed description of the invention.

DETAILED DESCRIPTION OF THE PREFERRED EMBODIMENT

Figure 1:
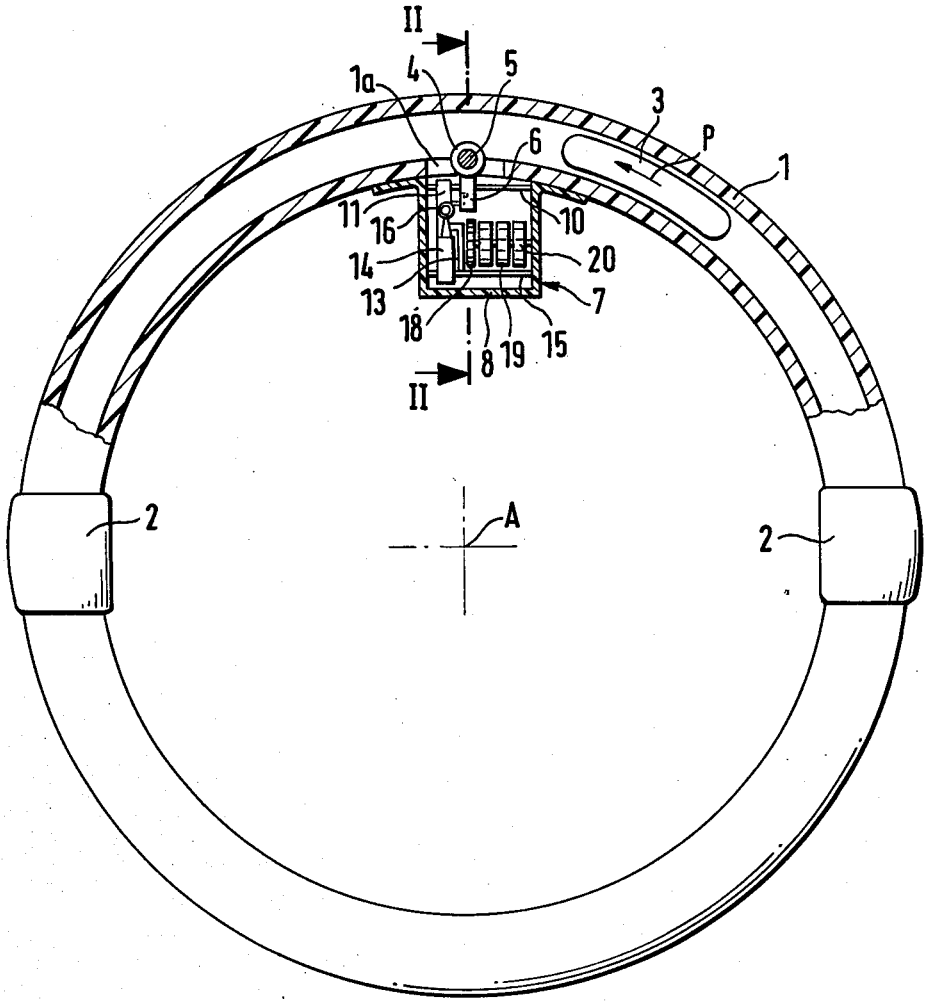
FIG. 1 is an overhead view, partially cut away, of an improved exercise device with a mechanical counter.

As shown in FIG. 1, the improved exercise device comprises a hollow loop 1, preferably made of synthetic material, having two opposed handles 2. A generally cylindrical weight 3 having a diameter somewhat smaller than the inside diameter of the hollow loop 1 is located within the hollow passage of the hoop. This weight 3 should preferably be made of a heavy metal, such as steel or lead. In principle, the weight 3 can also be made of a heavy liquid. In an improved exercise device designed for adults, the hoop 1 would preferably have a diameter of approximately 63 to 70 centimeters.

At a point essentially equidistant from the two handles 2, the hoop 1 has an opening 1*a*, at which point is fastened a housing 8 that contains a counter 7. This counter 7 records the number of times the weight 3 circulates past a roller 4. Thus, when a person steps inside of the hoop, grabs it by its two handles 2 and rotates the hoop such that the weight 3 traverses one revolution, the counter 7 steps up by one unit.

Figure 2:
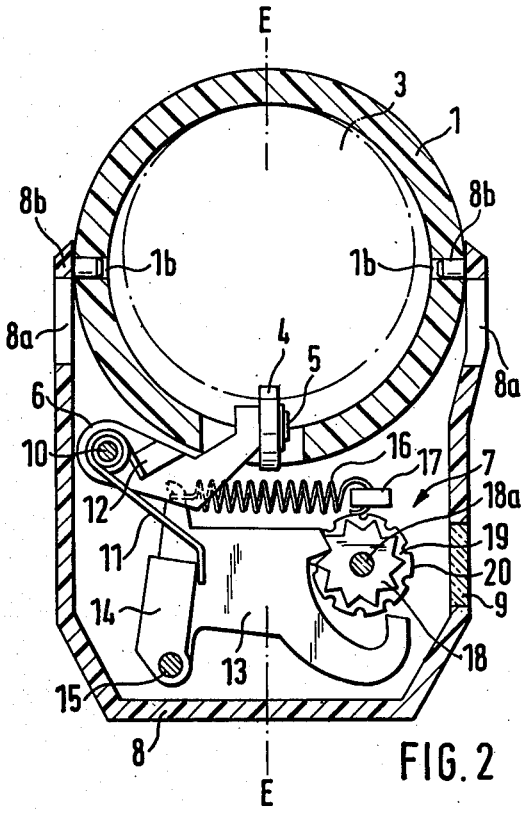
FIG. 2 is a cross-sectional view according to the line II—II of FIG. 1.

In reference to FIG. 2, the housing 8 has two sides 8*a*, preferably made of plastic, each of which attached to the hoop 1 by means of pins 8*b* that fit in holes 1*b*. Within the housing 8 is a lever 6 that pivots about axis 10. At the end of lever 6 furthest from axis 10 is attched a roller 4 that rotates about an axis 5. This axis 5 is transverse to axis 10. A helically wound spring 11 is attached to lever 6 at axis 10. This spring 11 is also attached under tension to a stop 14. Stop 14 is in turn attached to a lever 13, which pivots about an axis 15 that is parallel to the axis 10. One end 13*a* of the lever 13 is connected by a tension spring 16 to the housing 8 by means of tab 17. The opposed hook ends 13*b* and 13*c* of the lever 13 are both engageable with a star wheel 18 having ten teeth. The star wheel 18 rotates about an axis 18*a*, which is parallel to the axes 10 and 15. Attached to the axis 18*a* are several additional star wheels which have the numbers 0–9 on their outside diameter at uniform distances. Thus, with each step of the counter 7, these star wheels are stepped up by one unit in a manner well known in the prior art.

Thus when the weight 3 passes through the hollow passage of the hoop 1 it strikes the roller 4. The lever 6 is then pivoted about the axis 10 and, as a result, lever 13 is pivoted by means of spring 11. As the lever 13 is pulled back, the hook end 13*c* engages a tooth of the star wheel 18 and turns the star wheel 18 one-tenth of its circumference. When the weight 3 passes beyond the roller 4, levers 6 and 13 return to their original positions by means of the tension springs 11 and 16. The hook end 13*b* then engages the star wheel 18 and prevents any further movement of the star wheel 18 until the weight 3 again passes over the roller 4.

The numbers 20 of the counter wheels 19 are clearly visible through a window 9 in the housing 8. The window 9 and the numbers 20 both lie in planes that are essentially parallel to the plane of the hoop. Thus, when one uses the improved exercise device for shaping up, one holds the hoop 1 so that the window 9 is pointing upwards. Then when the user rotates the hoop 1 he can constantly monitor the numbers 20 displayed by the counter 7 and know at a glance the number of revolutions the weight 3 has made around the hoop.

The counter 7 can be designed in such a way that it is stepped up by one number with each circulation of the weight 3 throughout the hoop 1 regardless of the direction of the weight's circulation. Alternatively the counter 7 can also be designed in such a way that it has two sets of number wheels 19 where one set of number wheels are stepped up only when the weight 3 circulates in one direction and the other set of number wheels are stepped up only when the weight 3 circulates in the opposite direction. Also, the counter 7 may be equipped with a set back device such that the counter 7 may be conveniently set to zero when an exercise program is started.

Figure 3:
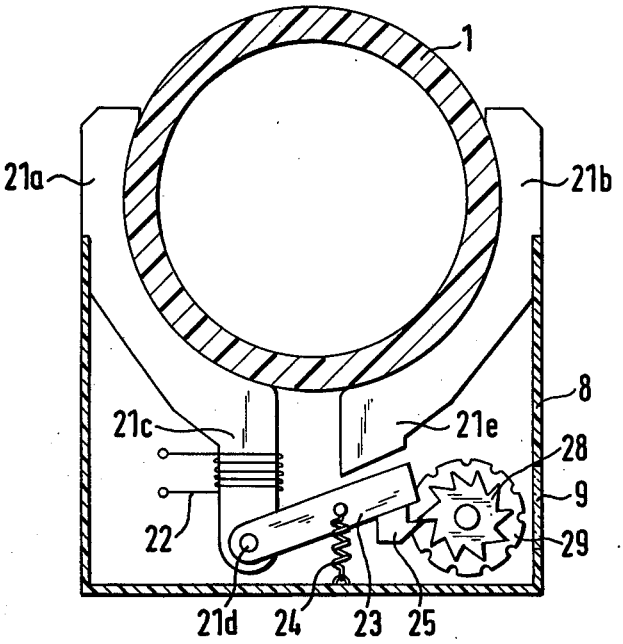
FIG. 3 is a cross-sectional view similar to FIG. 2, but of an improved exercise device with an electromagnetic counter.

FIG. 3 shows an embodiment of the present invention having an electromagnetic counter. Specifically, two electromagnetic poles 21*a* and 21*b* are located on opposite sides of the hoop. Attached to pole 21*a* is leg 21*c* about which is wound a coil 22. Current passing through the coil 22 causes the armature 23 to pivot towards the leg 21*e* about the armature's axis 21*d*. The armature 23 is biased away from the leg 21*e* by a tension spring 24. On the free end of the armature 23 there is a tooth 25 which is engageable with a star wheel 28 with ten teeth to which a number wheel 29 is attached. This number wheel can be observed through a window 9 in the housing 8.

Thus, as the weight 3 encounters the electromagnetic poles 21*a* and 21*b*, a current is generated in the coil 22 such that the tooth 25 disengages the star wheel 28. When the weight 3 has passed the poles 21*a* and 21*b*, the current in coil 22 is dissipated and the tooth 25 engages a tooth of the star spring 24 and turns the star wheel 28 one-tenth of its circumference. Additional star wheels may be attched to the axis of star wheel 28 in the manner referred to above.

Figure 4:
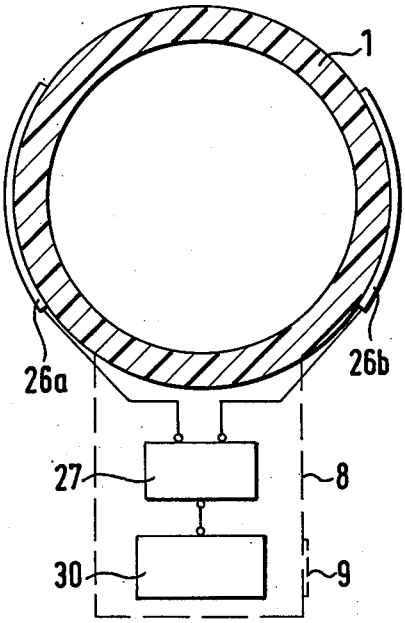
FIG. 4 is a cross-sectional view similar to FIG. 2, but of an improved exercise device with an electronic counter.

FIG. 4 shows an improved exercise device with an electronic counter. Two electrodes 26*a* and 26*b* are located on opposite sides of the hoop 1. The electrodes are connected to the input of an amplifier 27 whose output is connected to an electronic counter 30. The electronic counter 30 preferably has a liquid crystal digital display. The amplifier 27 and the counter 30 are placed in the housing 8 so that the numbers of the electronic counter can be read through window 9. Thus, as the weight 3 proceeds past the electrodes 26*a* and 26*b* the electronic counter 30 steps up by one unit.

Figure 5:
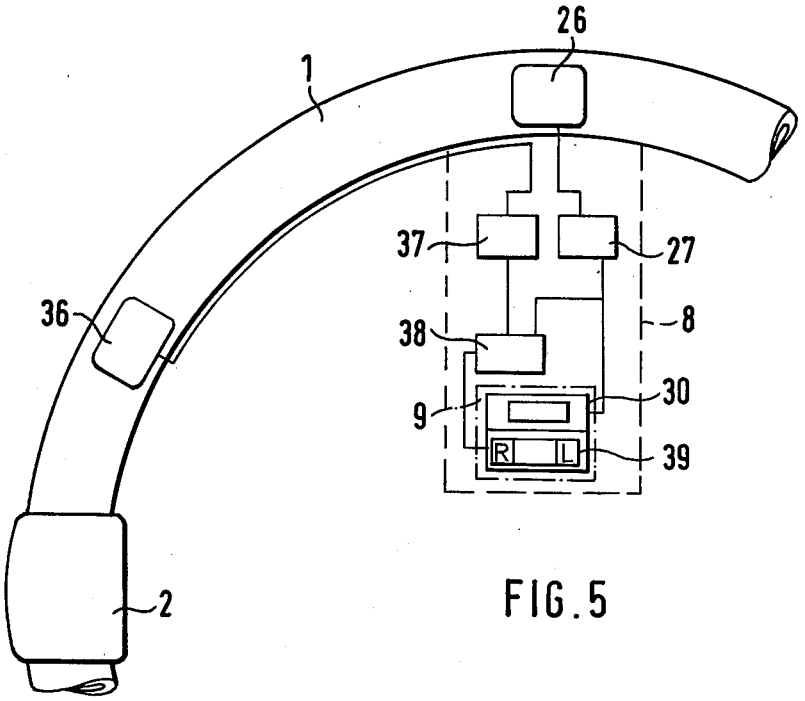
FIG. 5 is an overhead view, partially cut away, of an improved exercise device with a speed sensor and an electronic counter.

FIG. 5 shows the preferred embodiment of an arrangement according to FIG. 4 combined with a speed sensor. Besides the first pair of opposed electrodes 26, there is a second pair of opposed electrodes 36, which are spaced at a distance of about one-sixth the diameter of the hoop. The electrodes 26 are connected to an amplifier 27, while the electrodes 36 are connected to the input of an amplifier 37. The outputs of the amplifiers 27 and 37 are connected to a comparator 38, which generates a signal corresponding to the time differential of the weight's passage through the electrostatic fields of the spaced pairs of electrodes 26 and 36. This time differential output is then fed into an electronic counter 39. The electronic counters 30 and 39 are arranged so that they may both be read through the window 9 in the housing 8. The counter 39 displays the speed of the weight in flashing liquid crystal numbers and may also indicate the direction of rotation of the weight 3. The counter 30 simultaneously displays the number of revolutions of the weight.

Figure 6:
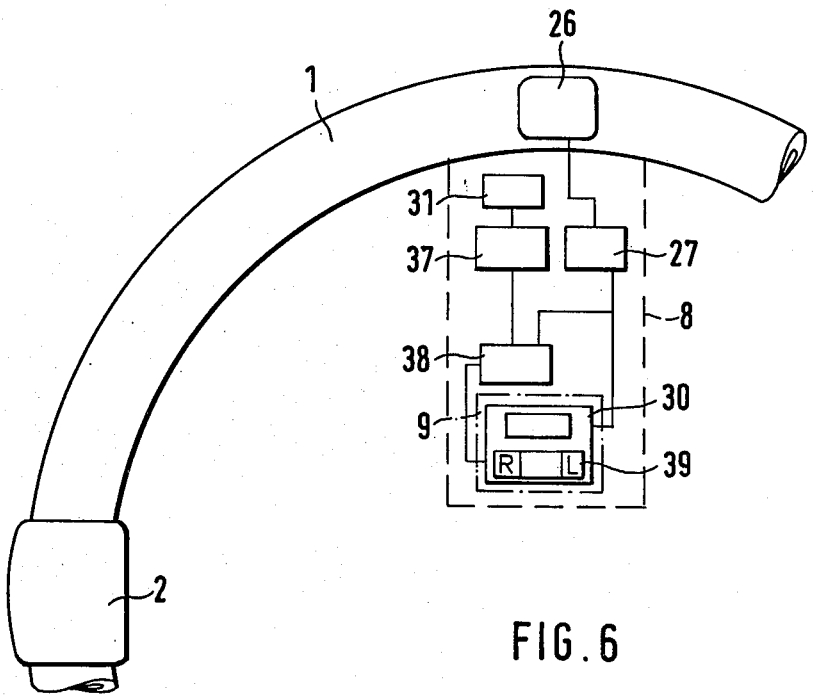
FIG. 6 is also an overhead view, partially cut away, of an improved exercise device with an alternative speed sensor and an electronic counter.

An alternative preferred embodiment is shown in FIG. 6 where, in place of the second pair of electrode 36 of FIG. 5, a time signal transmitter 31 is used. This time signal transmitter 31 transmits signals separated by a uniform predetermined time interval to the amplifier 37. This time interval is on the order of magnitude of the circulating time of the weight 3. Preferably, the time signal transmitter is set to a predetermined time interval or, alternatively, is adjustable so that the user can determine the set time interval.

Another possible embodiment of the speed sensor is a photosensitive system by which a light ray passes through the inside of the hoop. This light ray would be interrupted by the weight 3 once on each revolution of the weight 3. For example, a light generating diode could be substituted for the electrode 26*a* shown in FIG. 4 and a photodiode substituted for the electrode 26*b*. The hoop 1 would have to have holes on its inside surface for the light ray to pass at these spots. Thus, the photosensitive system would detect the weight 3 as it interrupted the path of light.

Thus, this preferred embodiment allows the user of the exercise device to easily and constantly monitor both the number of revolutions of the weight around the hoop and the speed of the weight's revolution. Therefore, the user can keep track of the amount and level of effort of his exercise session. This keeps him more interested in using the device and allows him to set goals for himself. Generally, this results in more frequent and longer use of the improved exercise device and, more importantly, the improved health of the user.

I claim as my invention:

1. In an exercise device characterized by a hoop having a circumference, a hollow passage and a circulating weight in the hollow passage, the circulating weight being capable of travelling through the hollow passage around the circumference of the hoop upon rhythmic rotation of the hoop, the improvement in combination therewith comprising, a counter means capable of counting the revolutions of the circulating weight around the circumference of the hoop and a speed sensor means capable of measuring the speed of the circulating weight.

2. The improved exercise device of claim 1 wherein said hoop has a pair of circumferentially opposed handles.

3. The improved exercise device of claim 1 wherein said counter comprises a plurality of levers and a star wheel, at least one of said levers being engageable with said star wheel such that when the circulating weight activates said levers, said levers step up said star wheel counter by one unit.

4. The improved exercise device of claim 1 wherein said counter comprises an opposed pair of electromagnetic poles, a lever and a star wheel, said lever being engageable with said star wheel such that when the circulating weight passes said electromagnetic poles, said lever is activated and steps up said star wheel by one unit.

5. The improved exercise device of claim 1 wherein said counter is comprised of a pair of opposed electrodes, said electrodes being connected to an amplifier, said amplifier being connected to an electronic counter.

6. The improved exercise device of claim 5 wherein said electronic counter has a liquid crystal digital display.

7. The improved exercise device of claim 1 wherein said speed sensor comprises a plurality of pairs of spaced, opposed electrodes, said pairs of electrodes being connected to separate amplifiers, said amplifiers being connected to a comparator, said comparator being connected to an electronic counter.

8. The improved exercise device of claim 1 wherein said speed sensor comprises a pair of spaced, opposed electrodes and a time signal transmitter, said pair of spaced, opposed electrodes being connected to a first amplifier, said time signal transmitter being connected to a second amplifier, said first and second amplifier being connected to a comparator, said comparator being connected to an electronic counter.

9. The improved exercise device of claim 1 wherein said counter has a numerical display, said numerical display being substantially parallel to the plane of said hoop.

10. The improved exercise device of claim 1 wherein said speed sensor has a numerical display, said numerical display being substantially parallel to the plane of said hoop.

11. The improved exercise device of claim 7 wherein said pairs of electrode are spaced at a distance of approximately one-sixth the diameter of said hoop.

12. The improved exercise device of claim 1 wherein said speed sensor comprises a photosensitive system.

13. The improved exercise device of claim 12 wherein said photosensitive element comprises a diode and a photodiode.

14. The improved exercise device of claim 1 wherein said counter comprises a first pair of opposed electrodes, said first pair of electrodes being connected to a first amplifier, said first amplifier being connected to a first electronic counter; and said speed sensor comprises a second pair of opposed electrodes, said second pair of electrodes being spaced from said first pair of electrodes, said second pair of electrodes being connected to a second amplifier, said first and second amplifiers being connected to a comparator, said comparator being connected to a second electronic counter.

* * * * *